United States Patent [19]

Wylie

[11] Patent Number: 4,744,202

[45] Date of Patent: May 17, 1988

[54] APPARATUS AND METHOD FOR MAINTAINING UNIFORM, REGISTRATION IN A PACKAGING MACHINE

[75] Inventor: Richard D. Wylie, Gaffney, S.C.

[73] Assignee: Milliken Research Corporation, Spartanburg, S.C.

[21] Appl. No.: 67,426

[22] Filed: Jun. 26, 1987

Related U.S. Application Data

[63] Continuation of Ser. No. 931,274, Nov. 14, 1986, abandoned.

[51] Int. Cl.[4] ..... B65B 9/12; B65B 9/20; B65B 41/18; B65B 57/04

[52] U.S. Cl. ..... 53/451; 53/51; 53/551

[58] Field of Search ..... 53/51, 551, 451, 552, 53/554, 575, 576; 493/196, 197, 209

[56] References Cited

U.S. PATENT DOCUMENTS

| | | | |
|---|---|---|---|
| 2,113,658 | 4/1938 | Lakso | 53/551 |
| 2,385,229 | 9/1945 | Patterson | 53/551 X |
| 2,636,731 | 4/1953 | Howard | 53/551 X |
| 2,636,732 | 4/1953 | Howard | 53/551 X |
| 3,294,301 | 12/1966 | Richter | 53/51 X |
| 3,546,835 | 12/1970 | Mobley | 53/51 X |
| 4,023,327 | 5/1977 | Simmons | 53/552 X |
| 4,288,965 | 9/1981 | James | 53/551 X |
| 4,501,109 | 2/1985 | Monsees | 53/551 X |
| 4,546,596 | 10/1985 | Cherney | 53/551 X |

*Primary Examiner*—Horace M. Culver
*Attorney, Agent, or Firm*—George M. Fisher; H. William Petry

[57] ABSTRACT

A method and apparatus for controlling the relative position of printing appearing on packages formed by form-fill-seal packaging machine in which individual packages are formed in substantially continuous fashion from a web of pre-printed package stock. Pre-printed registration indicia are detected on the web of package stock, and a control signal if generated which actuates a tension regulating device which varies the tension applied to the package stock as the package stock is formed into packages. In a preferred embodiment, the tension regulating device comprises a roll having selectable rotational resistance, over which the web is partially wrapped.

11 Claims, 3 Drawing Sheets

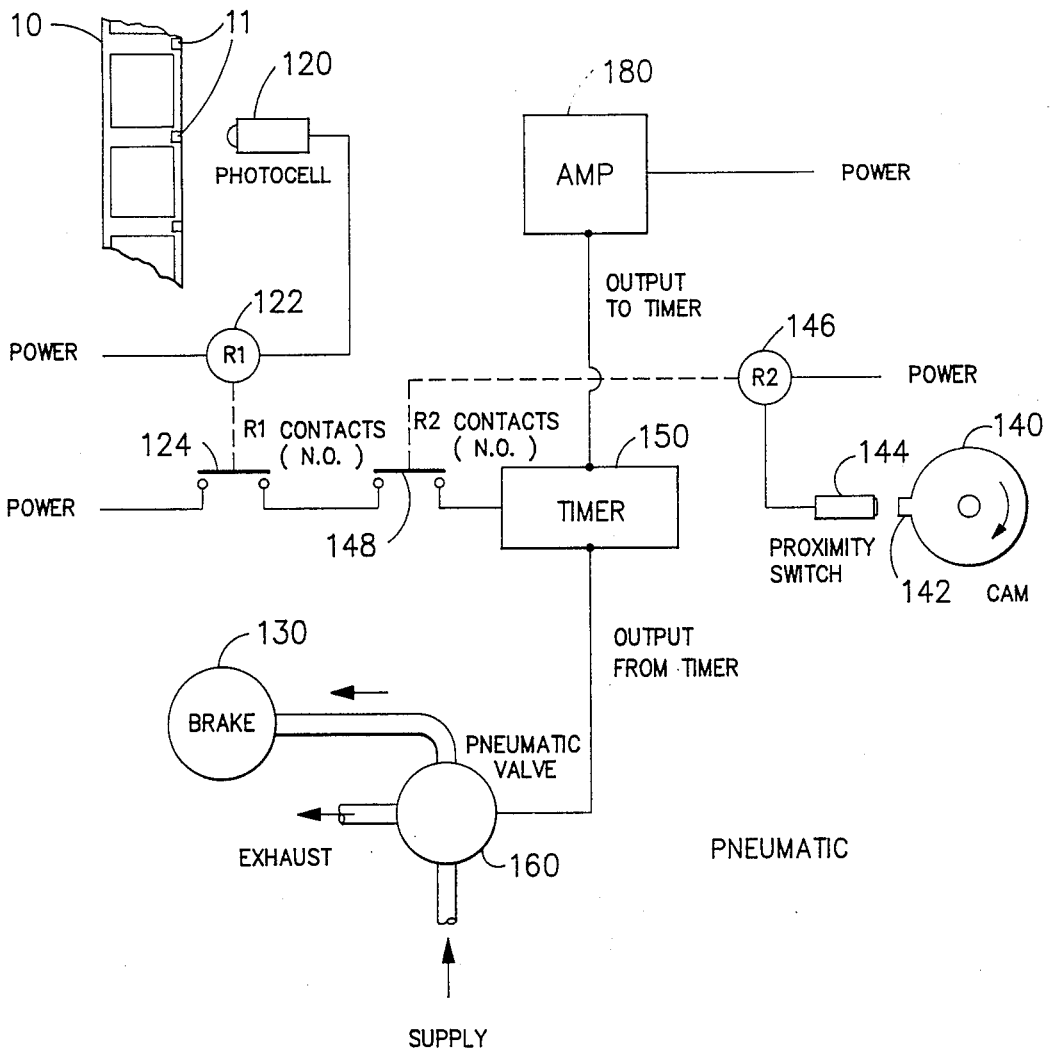
*FIG. —4—*

APPARATUS AND METHOD FOR MAINTAINING UNIFORM, REGISTRATION IN A PACKAGING MACHINE

This application is a continuation of application Ser. No. 06/931,274, now abandoned.

This invention relates to an apparatus and method for controlling the registration of pre-printed web package stock in a packaging machine. In a preferred embodiment, this invention relates to an apparatus and method for modifying the rate at which pre-printed stock is supplied to a machine designed to produce tetrahedron-shaped packages from a flat web, in order to maintain the relative position on the package of the printed matter appearing on the pre-printed package stock as the stock is formed into individual packages.

Machines which are designed to produce cushion shaped, parallelepipedic, or tetrahedral packages from a continuous roll or flat web of packaging material are well known in the packaging industry. Commonly, such machines are of the "form-fill-seal" variety, in which a continuous flat web of suitable packaging material, e.g., wax or plastic-coated paper which has been pre-printed with a label, is formed into a vertically oriented tube-like structure. This is accomplished by passing the web through one or more ring-like guides and forming a vertical seam by adhesively joining the longitudinal edges of the web. This tube is then filled with the desired product. By compressing opposing sides of the tube in the presence of an adhesive or, more commonly, heat, the tube may be transversely sealed as the tube moves through the machine, thereby forming individual packages. The separate, connected packages may then be separated from one another by cutting the tube in the region of the transverse seams.

It is known that registration of the printed matter on the individual packages can be adversely affected if the rate at which the packages are formed is not equal to the rate at which the product to be packaged is made available to the machine. In many cases the rate of product manufacture cannot be independently adjusted without adversely affecting product quality. It is also known that variations in the level of product to which the packaging material tube is filled prior to end seal formation causes variations in the size of the resulting packages. These size variation can adversely affect the uniformity of package volume and product, and can cause any labels or preprinted matter on the web of packaging material to become mis-registered with respect to the placement of the transverse seams, and therefore become improperly located on the individual packages. This variation in package size is believed to be due to slight changes in the diameter of the tube of packaging material used to form the packages, which variations in turn are believed to be generated in part by variations in height of the product column, and therefore the outward pressure generated by the column, above the location at which the transverse seal is to be formed. In packaging machines wherein the web of packaging material is drawn into the machine by the uniform, continuous action of a series of opposed sealing jaws or the like mounted on drive chains and having a fixed, uniform spacing between adjacent jaws, it is desirable to be able to adjust the rate at which the packaging material is presented to the sealing jaws without changing the spacing of the sealing jaws. By such adjustment, the registration or position of the printed matter on the web with respect to the sealed package ends may be controlled. It is especially desirable to be able to make such registration adjustments in a continuous and automatic fashion.

Numerous techniques have been employed in an effort to achieve this goal. For example, U.S. Pat. No. 3,546,835 to Mobley discloses a system comprising a photoelectric cell and a tube forming ring having a variable ring diameter. In operation, the photocell detects pre-printed registration marks, which causes, via relays, a pneumatically actuated piston to vary the diameter of a tube forming ring, thereby increasing or decreasing the diameter of the package tube from which the packages are made. As explained in U.S. Pat. No. 3,546,835, as well as hereinbelow, the geometry of the tetrahedron package is such that a change in the diameter of the package tube results in a proportional change in the length of the resulting tetrahedron package. By varying the tube diameter, individual package length, and therefore print registration, may be controlled.

The above method, however, has proved unsatisfactory. It is believed a major cause of registration non-uniformity is variations in the fill level of product within the tube. If the level to which the tube is filled is not maintained with strict uniformity, the resulting pressure variations caused by the varying weight of the product within the tube and the flexible nature of the web material causes undesirable time-varying bulges or variations in the diameter of the tube, which in turn affects registration, as discussed above.

It is desirable to control to a very close degree the longitudinal position of the web material so that the information printed on the web material will be in substantially the same place on each package in order to provide appealing and consistent packages. If the position of the web material is not controlled, it may be necessary to have two repeats of the same printed matter for each package length of web material, which would result in smaller printing on each package and variations in the relative positioning of the printed information. It is also desirable to maintain consistent placement of the labels on individual packages in order to maintain the appearance of high standards of product uniformity and quality control. In the trade, such control of the position of the printed information on the package is referred to as "registered print."

This invention provides an apparatus and method suitable for maintaining registration of the print, i.e., maintain the relative position of the printed matter on the package, on a machine producing tetrahedron packages which uses a continuous and preferably uniform web material advancing mechanism, and which can be used to produce a plurality of filled tetrahedron packages on which the printing on the outside surface of each package is substantially in the same position on each such package, by controlling the tension of the web material during the package formation process. It has been found that, by varying the tension on the web in the direction of web travel as it is introduced into the package machine, the length of packages formed from a given linear length of package stock may be varied, thereby allowing undesirable registration variations due to package fill levels, etc., to be overcome. In a preferred embodiment, variations in registration are detected by photoelectric means, using evenly spaced index marks pre-printed along one edge of the web of package stock. Appropriate signals are then sent to a web tensioning device which can adjust the tension imparted to the web by inhibiting, in a controlled manner, the linear motion of the web as it is being drawn into the machine. In a preferred embodiment, web tension may be controlled by passing the web over one or more rolls which are positioned so as to present a significant "wrap angle" or circumferential contact angle and which provide a substantially uniform contact area across the width of the web. Under such conditions, contact between the moving web and a stationary roll surface is sufficient to generate significant frictional drag uniformly across the width of web, resulting in the laterally uniform application of longitudinal (i.e., lengthwise) tension to the web. By varying the degree to which the roll is inhibited from rotating at a circumferential speed equal to the linear speed of the web, varying amounts of uniformly-applied tension may be applied to the web.

Details and advantages of this invention will become readily apparent from the following discussion, when read in conjunction with the accompanying Figures, in which FIG. 1 is a schematic representation of a form-fill-seal packaging machine designed to make tetrahedral-shaped containers filled with product from a continuous web of suitable packaging material, showing a tension control device embodying the instant invention;

FIG. 4 is a schematic representation of a control circuit for the registration tension device shown in FIG. 3.

Figure 2:
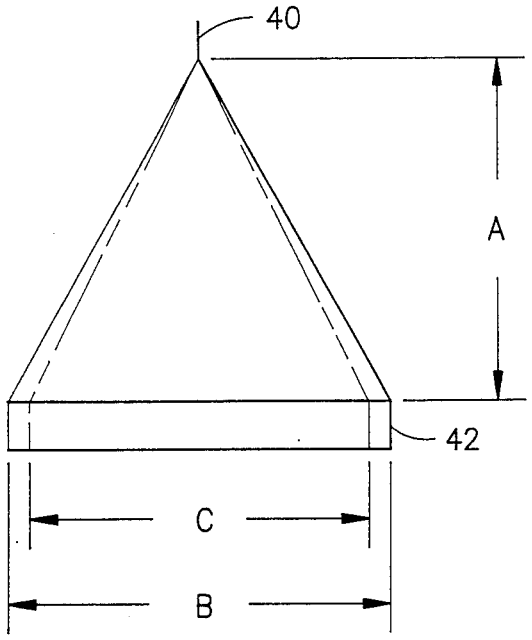
FIG. 2 is a schematic representation of a representative tetrahedron package formed by the machine of FIG. 1, which illustrates the relationship between package diameter and package length.

As suggested above, it is very difficult to maintain registration of printed matter on sheet packaging material in a tetrahedron forming machine which operates continuously and has the sealing jaws fixed in relation to one another. In a tetrahedron-shaped package, as shown in FIG. 2, the vertical distance A is less than the net length of sheet material between the transverse seals 40 and 42. This is due to the fact that, as measured perpendicular to the longitudinal axis of tube 50, adjacent transverse seals are formed at right angles to each other, and the sheet material therefore may be thought of as extending along the hypotenuse of a triangle. The net length of the sheet material between the transverse seals of a package may be controlled by controlling the diameter or perimeter length of the tubular shaped sheet material from which the package is formed. As the diameter or perimeter length of the tubular shaped sheet material decreases, the net length of the sheet material approaches the vertical distance A. Conversely, the net length of the sheet material increases as the diameter or perimeter length of the sheet material increases. FIG. 2 illustrates this principle by indicating that, when the diameter or perimeter length of the tubular sheet material is large, as indicated by the length B of the transverse seal, a package, indicated in solid lines, is obtained which has a net wall length which is longer than the net wall length of the package shown in phantom lines. This "phantom line" package depicts a package made from a section of tubular sheet material which has a reduced diameter or perimeter indicated by the transverse seal length C. Thus, it can be seen that the amount of sheet material in each tetrahedron-shaped package, and therefore the net length of such package, can be controlled by controlling the diameter or the circumferential length of the tubular sheet material from which the package is formed.

In the instant invention, such control is maintained by adjusting the tension placed on the sheet material which is being formed into a tubular structure and filled with product. By increasing the tension in the region immediately above the sealing jaws associated with the upper-most transverse seal, tube side walls are made more resistant to outward deformation by the pressure of product within the tube, and therefore such increasing tension tends to reduce the diameter of the tube prior to the formation of such upper-most transverse seal.

Figure 1:
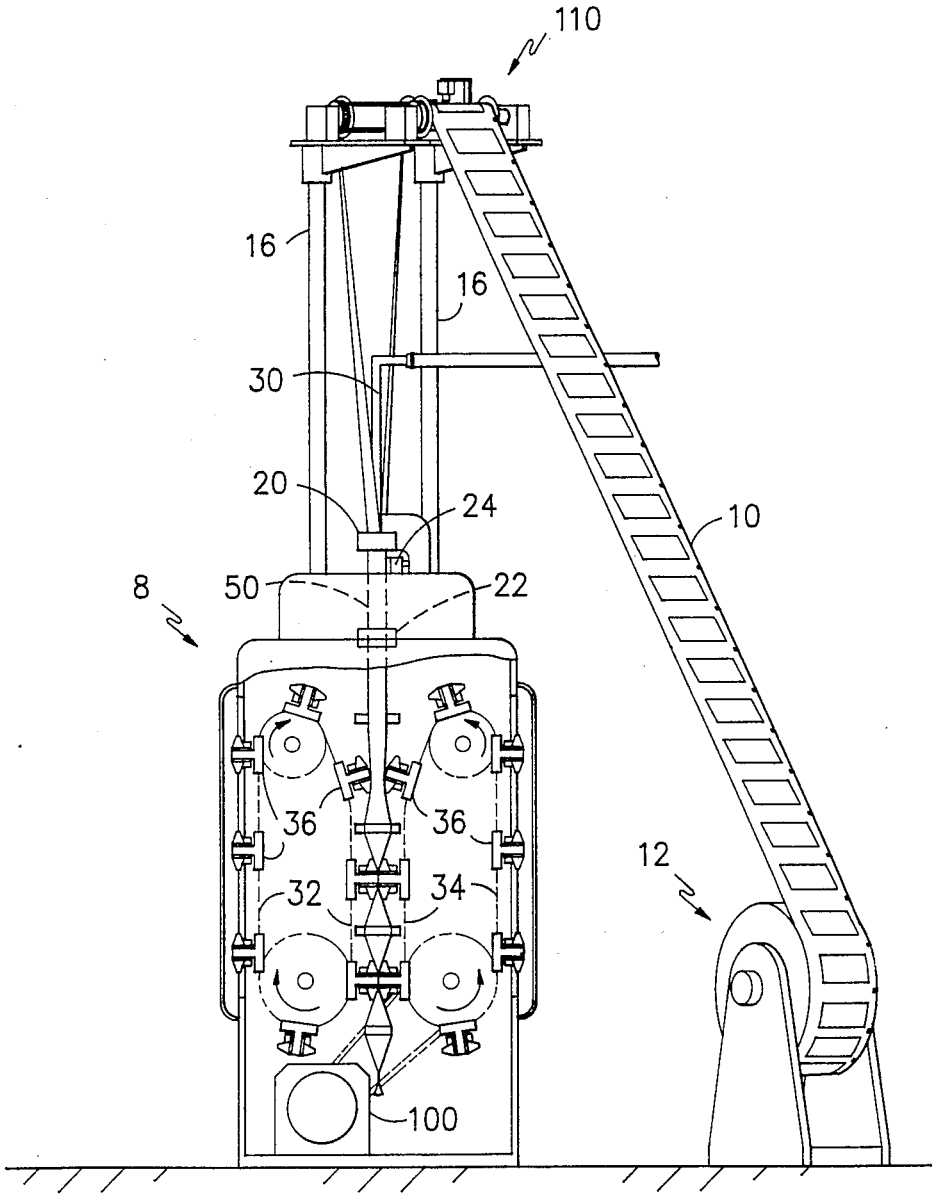

In the embodiment of the instant invention shown in FIG. 1, a typical tetrahedron forming machine 8 is shown which forms tetrahedron-shaped filled containers from a roll of pre-printed flat package stock, e.g., a polyethylene coated paper. The paper 10 is supported on a suitable support 12 and is delivered upwardly over a set of guide rolls associated with tension control device 110, which rolls are supported by frame members 16 secured to the machine. The paper 10 is delivered downwardly through a oval collar 20 which longitudinally curls the paper 10 by bending the longitudinal edges of the sheet material toward one another. From the collar 20 the sheet material passes through a circular forming ring 22 where the overlap of the longitudinal edges is completed, and the package stock is in closed cylindrical (tube) form. An elongate heater 24 seals together the overlapped longitudinal edges with the assistance of a set of opposed rollers, not shown, between which the heated longitudinal edges are pressed together.

A fill pipe 30 is positioned to extend within the tube 50 of package stock, and extends to a point above the region where the transverse seals 40,42 (FIG. 2) are formed. To form the first and second transverse seals, two sets of endless chains carrying opposed heated sealing jaws 36 at fixed locations along the chains are continuously and uniformly rotated by driven sprockets. One set of endless chains is represented by reference numerals 32 and 34 while a second set of chains (not shown) is located parallel to the axis of the tubular sheet material and perpendicular to the first set of chains 32 and 34, i.e., to the front and rear of the view depicted in FIG. 1. As shown, the heating jaws 36 on the first set of chains form a transverse seal and simultaneously advance, via a pulling action, the tubular sheet material downwardly through the machine. The heating jaws on each set of chains are spaced two package lengths from one another, so that the heating jaws 36 on the second set of chains, located between, and axially displaced from, the heating jaws 36 on the first set of chains, have room to form a second transverse seal which is one package length away from and transverse to the first seal. Due to the staggered or interleaved relative positioning of the jaws on the first and second sets of chains, the top-most seal will be made by jaws carried on the first set of chains, then by jaws carried on the second set of chains, in alternating fashion. It can be seen that the continuously moving heating jaws form the first transverse seal in a region already occupied by product while the product is being supplied from the fill pipe, form the second transverse seal also in a region occupied by product, and supply a continuous chain of packages to a cutting means, not shown, wherein the transverse seals are severed along their length to form individual packages.

Figure 3:
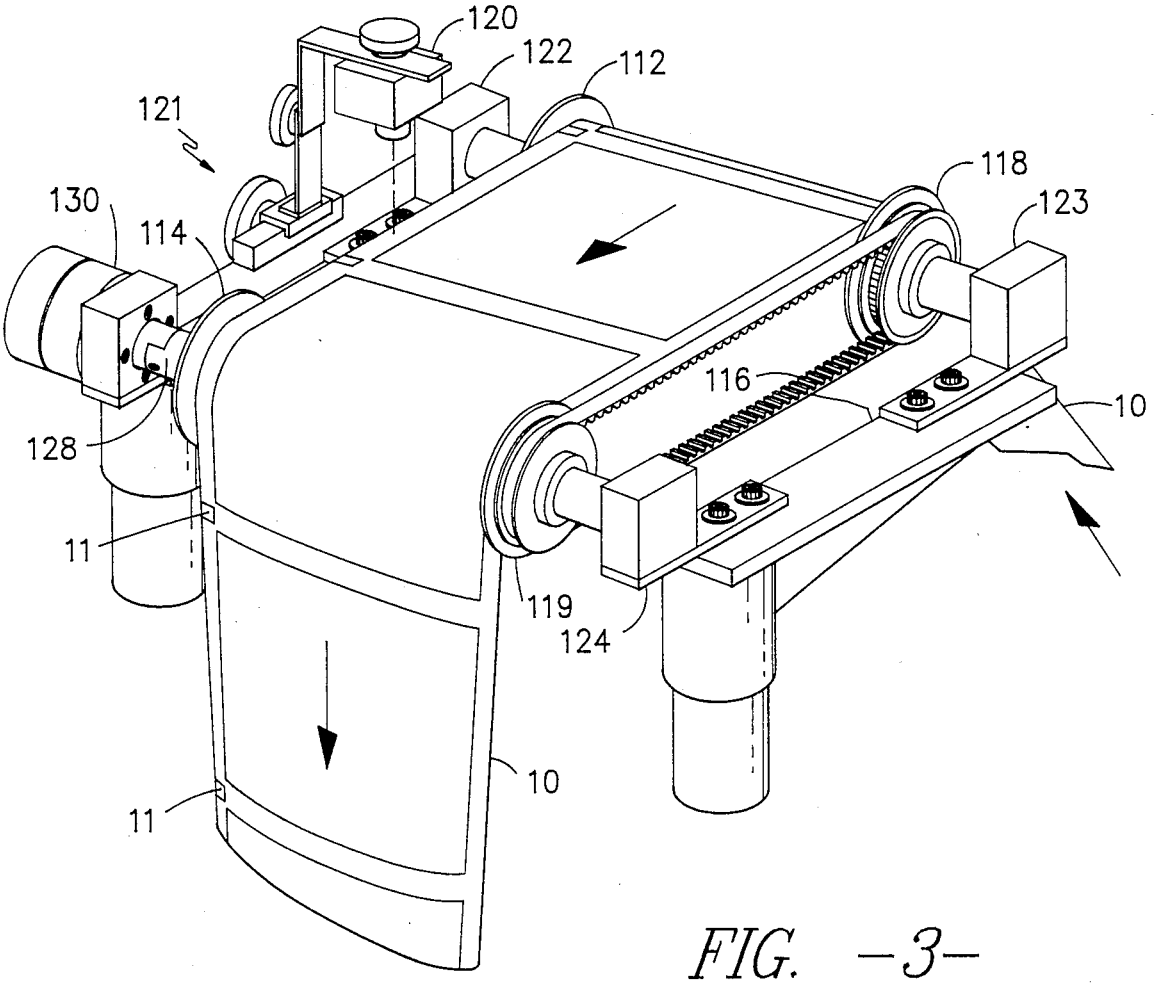
FIG. 3 is a perspective view of a registration tension device which provides control of the position of the printing on a completed tetrahedron package in accordance with the instant invention.

FIG. 3 shows in more detail the tension control device 110 of FIG. 1 used to vary the tension on package web 10 in the region above jaws 36. Web 10 is fed from a supply roll to the top of packaging machine 8 where it is directed over two aligned, flanged guide rolls 112,114 positioned on supports 16. Guide roll 114 is appropriately positioned over machine 8 to allow for satisfactory formation of package tube 50 by collar 20, etc., and to provide sufficient wrap angle to allow for the generation of the necessary frictional forces. The rotation of guide rolls 112,114 are synchronized by a closed loop in the form of a chain or toothed belt 116, which cooperates with toothed pulleys 118,119 associated with respective rolls 112,114 to assure that rolls 112,114 always rotate in synchrony. Of course, other synchonizing means may be used or such means may be found to be unnecessary under some conditions. The surface of rolls 112,114 may be smooth and somewhat slick or may be of a material or texture so as to maximize the frictional retardation effect experienced by a moving web 10 being pulled over a more slowly rotating (or completely stationary roll surface. Photocell assembly 120 may be positioned as necessary to provide for detection of preprinted registration indicia 11 located along the edge of web 10. In the embodiment shown, photocell assembly 120 is located in reasonably close physical proximity to guide rolls 112,114, but other locations may be found to be advantageous. Adjustment means 121 such as a rack and pinion assembly may be used to shift the position of assembly 120 parallel to the path of web 10, so as to adjust precisely the length of web between assembly 120 and the advancing jaws. It is preferred that, where the seal is to be placed at the same location as the registration indicator, the web length extending from the top-most seal to registration indicator 11 be an integral number of desired package lengths.

Roll 112 is positioned by means of bearing supports 122,123. Roll 114 is positioned on one side by bearing support 124; the other side of roll 114 is positioned by means of a shaft coupling which may, for example, be of the split-diameter type, as shown. This shaft coupling serves to couple roll shaft 128 with microclutch/microbrake assembly 130. Assembly 130 allows free rotation of roll 114 (and, due to belt 116, roll 112) when unactuated, but effectively prevents roll 114 (and roll 112) from freely rotating when actuated. Assembly 130 may be actuated by any appropriate signal, e.g., electrical or pneumatic, depending upon the particular assembly chosen and the control apparatus employed. A preferred assembly is the "Air Champ" distributed by Horton Manufacturing Co., Inc. of Minneapolis, Minn., which is actuated pneumatically, but which is controlled by the signals generated by photocell 120, as explained below. While the discussion herein presumes that assembly 130 acts as a braking means to inhibit the free rotation of rolls 112,114, it is foreseen that roll 114 could be an actively driven roll, and assembly 130 could be a microclutch assembly which selectively varies the torque imparted to roll 114. Similarly, assembly 130 could be a variable speed motor which serves to drive roll 114 at speeds determined by an appropriate control signal.

Looking now at FIG. 4, when solenoid-actuated pneumatic valve is receiving no control signal from control timer 150, valve 160 merely exhausts pressurized air from a pressurized air supply to the atmosphere. When, however, a control signal is passed from amplifier 180 through control timer 150 to valve 160, pressurized air is routed to and actuates brake assembly 130, thereby retarding the rotation of rolls 112,114. In order for an actuating control signal to be passed through control timer 150 the normally open contacts associated with both relay R1, noted at 124, and relay R2, noted at 148, must be closed. This supplies an actuating signal to control timer 150, and initiates a timed cycle of pre-set (but user-adjustable) time period T which is equal to the elapsed time the rotational retardation is to take place. It is preferred that time period T is adjusted to be less than the elapsed time required for the passage of two consecutive registration marks to be noted by photocell assembly 120. Of course any suitable periodic, uniformly spaced markings on web 10 which may be detected by photocell assembly 120 may be used in place of indicia 11. Preferred photocell assemblies, amplifiers, and control timers are available from Electronics Corporation of America, Photoswitch Division, of Waltham, Mass., as Model 42RE1, Model 60-1490, and Module Type 23DF3 (Model 3000), respectively. By retarding the rotation of rolls 112,114 for time period T, increased tension is imparted to web 10 which tends to reduce the bulging of the walls of tube 10 immediately above jaws 36, and, consequently, causes smaller packages to be produced.

The momentary closing of relay R1 contacts 124 is achieved by the detection of the leading edge of registration indicia 11 by photocell assembly 120. The momentary closing of relay R2 contacts 148 is achieved by the detection of timing mass 142, fixed to the perimeter of registration control cam 140, passing in front of proximity detector switch 144. Cam 140 is driven in synchrony with the chains carrying jaws 36 and is positioned so that mass 142 is adjacent to proximity switch 144—and, consequently, relay R2 contacts 148 are closing—at the same moment jaws 36 are forming the top-most seal on tube 50. Photocell assembly 120 should be positioned via means 121 so that at the same moment relay R2 contacts are closing, detection of the leading edge of registration indicator 11 causes the momentary closing of relay R1 contacts. It may be seen, therefore, that at the moment the leading edge of a registration indicator 11 is detected by photocell assembly 120, the following events also occur in a properly operating control system as depicted in FIG. 4: (1) photocell assembly 120 actuates the momentary closing of relay R1 contacts 124; (2) proximity detector switch 144 senses timing mass 142 and causes the momentary closing of relay R2 contacts 148; and (3) the concurrent closing of relay contacts 124 and 148 serve to signal control timer 150 to pass a control signal from amplifier 180 to valve 160, thereby actuating brake assembly 130 and retarding the rotation of rolls 112,114. Control timer 150 continues to pass a control signal for time period T, even though relay contacts 124 and 148 have been reset to an open position, after which period the control signal to valve 160 is interrupted and the air to brake assembly 130 is instead vented to the atmosphere until relay contacts 124 and 148 are again concurrently closed.

Other means for adjusting the tension of the packaging material just prior to the time the packaging material is formed into individual packages by the action of the sealing jaws are foreseen. Various techniques for increasing package stock tension by inhibiting the linear movement of the packaging material as it enters the packaging machine may become apparent to those skilled in the art. For example, clamping means which, to maintain a balance of forces across the web, act either on both longitudinal edges of the web or over the full width of the web may be employed to effectively impart a "braking" action and resist the web advancing action of the sealing jaws, thereby increasing the tension in the packaging material. Likewise, it is believed control means other than that set forth above may be advantageously employed under various circumstances. While the method and apparatus described herein constitute a preferred form of the invention, it is believed the invention is capable of modification or adaptation without departing from the spirit of the invention.

I claim:

1. A method for controlling the registration of pre-printed package stock in a form-fill-seal packaging machine in which individual packages are formed in substantially continuous fashion, said package stock being drawn through said machine by the advancing action of moving sets of opposed jaws, said method comprising the steps of:

(a) supplying a quantity of package stock having registration indicia placed thereon at spaced intervals;

(b) guiding said package stock into said machine via a path in which said stock comes into operable contact with a linear motion inhibiting element prior to contacting said opposed jaws, said element having adjustable linear motion inhibiting action with respect to said stock;

(c) detecting the position of said registration indicia on said stock;

(d) adjusting the inhibiting action of said element in accordance with the position of said indicia, thereby adjusting the tension on that portion of said stock between said element and said opposed jaws.

2. The method of claim 1 wherein said element comprises roll positioned across the path of said stock, and said motion inhibiting action comprises rotational resistance of said roll.

3. The method of claim 2 wherein said rotational resistance is adjusted by means of a control signal which is generated in response to the detected position of said registration indicia.

4. A method for controlling the registration of pre-printed package stock in a form-fill-seal packaging machine in which individual packages are formed in substantially continuous fashion from a tube-like structure, said package stock being drawn through said machine by the advancing action of moving sets of opposed jaws, said jaws forming said packages by compressing opposing sides of said tube-like structure, thereby forming a transverse seal, said method comprising the steps of:

(a) supplying a quantity of package stock having registration indicia placed thereon at spaced intervals;

(b) guiding said package stock into said machine via a path in which said stock comes into operable contact with a linear motion inhibiting element prior to contacting said opposed jaws, said element having adjustable linear motion inhibiting action with respect to said stock;

(c) detecting the position of said registration indicia on said stock;

(d) detecting the position of said opposed jaws;

(e) adjusting the inhibiting action of said element in accordance with the position of said indicia and said opposed jaws, thereby adjusting the tension on that portion of said stock between said element and said opposed jaws.

5. The method of claim 4 wherein said element comprises a roll positioned across the path of said stock, and said motion inhibiting action comprises rotational resistance of said roll, and wherein said rotational resistance is adjusted by means of a control signal generated in response to the detected position of said registration indicia and said opposed jaws.

6. An apparatus for controlling the registration of pre-printed package stock carrying registration indicia thereon in a form-fill-seal packaging machine in which individual packages are formed in substantially continuous fashion from a web of said stock, said apparatus comprising:

(a) stock linear motion inhibiting means located in the path of said stock as said stock enters said machine, said stock being in operative contact with said inhibiting means;

(b) detecting means for detecting the position of said registration indicia on said stock;

(c) control means for actuating said linear motion inhibiting means in response to the position of said registration indicia as detected by said detecting means; and (d) advancing means for advancing said stock into said packaging machine, said advancing means located in said stock path following said inhibiting means, whereby actuation of said inhibiting means causes an adjustment in the tension of said stock located between said inhibiting means and said advancing means.

7. An apparatus associated with a packaging machine for continuously producing packages with correct registration from a web of packaging stock carrying registration indicia thereon, said web being supplied to said machine via roll means positioned in the path of said web, said web contacting said roll means so as to impart rotary motion to said roll means, said machine including tube forming means positioned in the path of said packaging material by which said material is formed into an elongate tube, said packages being formed by the action of opposed sealing means, positioned in the path of said packaging material following said roll means, which sealing means compress and seal together opposite sides of said tube along narrow zone disposed transversely to the longitudinal axis of said tube, said sealing means also serving to advance said tube through said machine, said apparatus comprising control means for generating a control signal in response to the position of said registration indicia carried by said web, and rotary motion inhibiting means operably associated with said roll means whereby the rotary motion of said roll means imparted by said web may be inhibited in response to said control signal, thereby increasing the tension on said packaging material between said roll means and said sealing means.

8. The apparatus of claim 7 in which said rotary motion inhibiting means comprises variable brake means.

9. The apparatus of claim 7 in which said rotary motion inhibiting means comprises variable clutch means.

10. The apparatus of claim 7 in which said roll means comprises a plurality of individual rolls which rotate in synchronism.

11. The apparatus of claim 7 which further comprises additional control means for generating a control signal in response to the position of said sealing means, and initiation means for initiating the actuation of said rotary motion inhibiting means only upon the concurrent generation of control signals from said control means and said additional control means.

* * * * *